US006508580B2

(12) United States Patent
Collins

(10) Patent No.: US 6,508,580 B2
(45) Date of Patent: Jan. 21, 2003

(54) PERSONAL SECURITY ASSEMBLY

(76) Inventor: Cynthia J. Collins, 330 12th Ave. North, Birmingham, AL (US) 35204

( * ) Notice: Subject to any disclaimer, the term of this patent is extended or adjusted under 35 U.S.C. 154(b) by 0 days.

(21) Appl. No.: 09/732,577

(22) Filed: Dec. 8, 2000

(65) Prior Publication Data

US 2002/0069905 A1 Jun. 13, 2002

(51) Int. Cl.[7] ..... A43B 5/00

(52) U.S. Cl. ..... 362/570; 362/459; 362/191; 362/102; 362/234; 362/396; 362/486; 136/16; 136/910; 280/288.4

(58) Field of Search ..... 362/570, 459, 362/86, 191, 102, 234, 396, 486; 135/16, 910; 280/288.4

(56) References Cited

U.S. PATENT DOCUMENTS 3,903,513 A 9/1975 Green et al.
4,423,473 A * 12/1983 Kirkley ..... 200/60
4,583,080 A * 4/1986 DiVito et al. ..... 135/910
4,837,559 A * 6/1989 Green, Sr. ..... 340/571
5,331,990 A 7/1994 Hall et al.
5,349,340 A 9/1994 Blumenthal
5,722,445 A * 3/1998 Hae et al. ..... 135/65
5,839,461 A 11/1998 Lambeth, Jr.
5,853,219 A 12/1998 Santuccio
D408,127 S 4/1999 Chapman

* cited by examiner

*Primary Examiner*—Sandra O'Shea
*Assistant Examiner*—Bertrand Zeade

(57) ABSTRACT

A personal security assembly for use in association with a mobility aide. The personal security assembly includes a housing, an audio alarm, an alert light for drawing attention. In an embodiment, a secondary light is provided for lighting an area proximate the mobility aide to enhance visual perception.

9 Claims, 3 Drawing Sheets

PERSONAL SECURITY ASSEMBLY

BACKGROUND OF THE INVENTION

1. Field of the Invention

The present invention relates to personal security devices and more particularly pertains to a new personal security assembly for use in association with a mobility aide.

2. Description of the Prior Art

The use of personal security devices is known in the prior art. More specifically, personal security devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,853,219; U.S. Pat. No. 3,903,513; U.S. Pat. No. 5,331,990; U.S. Pat. No. 5,839,461; U.S. Pat. No. 5,722,445; U.S. Pat. No. 5,349,340; and U.S. Pat. No. Des. 408,127.

While these devices fulfill their respective, particular objectives and requirements, the aforementioned patents do not disclose a new personal security assembly. The inventive device includes a housing, an audio alarm, an alert light for drawing attention. In an embodiment, a secondary light is provided for lighting an area proximate the mobility aide to enhance visual perception of the area by the user.

In these respects, the personal security assembly according to the present invention substantially departs from the conventional concepts and designs of the prior art, and in so doing provides an apparatus primarily developed for the purpose of use in association with a mobility aide.

SUMMARY OF THE INVENTION

In view of the foregoing disadvantages inherent in the known types of personal security devices now present in the prior art, the present invention provides a new personal security assembly construction wherein the same can be utilized for use in association with a mobility aide.

The general purpose of the present invention, which will be described subsequently in greater detail, is to provide a new personal security assembly apparatus and method which has many of the advantages of the personal security devices mentioned heretofore and many novel features that result in a new personal security assembly which is not anticipated, rendered obvious, suggested, or even implied by any of the prior art personal security devices, either alone or in any combination thereof.

To attain this, the present invention generally comprises a housing, an audio alarm, an alert light for drawing attention. In an embodiment, a secondary light is provided for lighting an area proximate the mobility aide to enhance visual perception.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personal security assembly apparatus and method which has many of the advantages of the personal security devices mentioned heretofore and many novel features that result in a new personal security assembly which is not anticipated, rendered obvious, suggested, or even implied by any of the prior art personal security devices, either alone or in any combination thereof.

It is another object of the present invention to provide a new personal security assembly that may be easily and efficiently manufactured and marketed.

It is a further object of the present invention to provide a new personal security assembly that is of a durable and reliable construction.

An even further object of the present invention is to provide a new personal security assembly which is susceptible of a low cost of manufacture with regard to both materials and labor, and which accordingly is then susceptible of low prices of sale to the consuming public, thereby making such personal security assembly economically available to the buying public.

Still yet another object of the present invention is to provide a new personal security assembly which provides in the apparatuses and methods of the prior art some of the advantages thereof, while simultaneously overcoming some of the disadvantages normally associated therewith.

Still another object of the present invention is to provide a new personal security assembly for use in association with a mobility aide.

Yet another object of the present invention is to provide a new personal security assembly which includes a housing, an audio alarm, an alert light for drawing attention. In an embodiment, a secondary light is provided for lighting an area proximate the mobility aide to enhance visual perception.

Still yet another object of the present invention is to provide a new personal security assembly that emits an audible and visual alarm upon activation by a user.

Even still another object of the present invention is to provide a new personal security assembly that is either integrally incorporated into or attachable to a mobility aide such as a wheelchair, walker, or cane.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
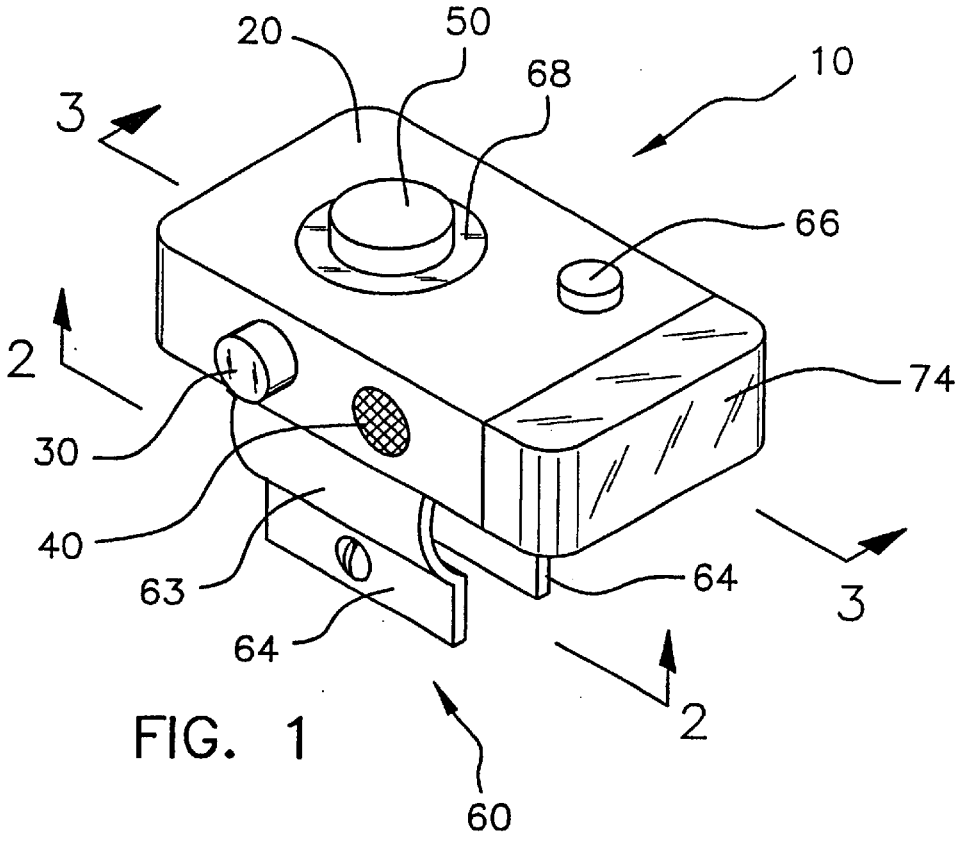
FIG. 1 is a perspective view of a new personal security assembly according to the present invention.
Figure 2:
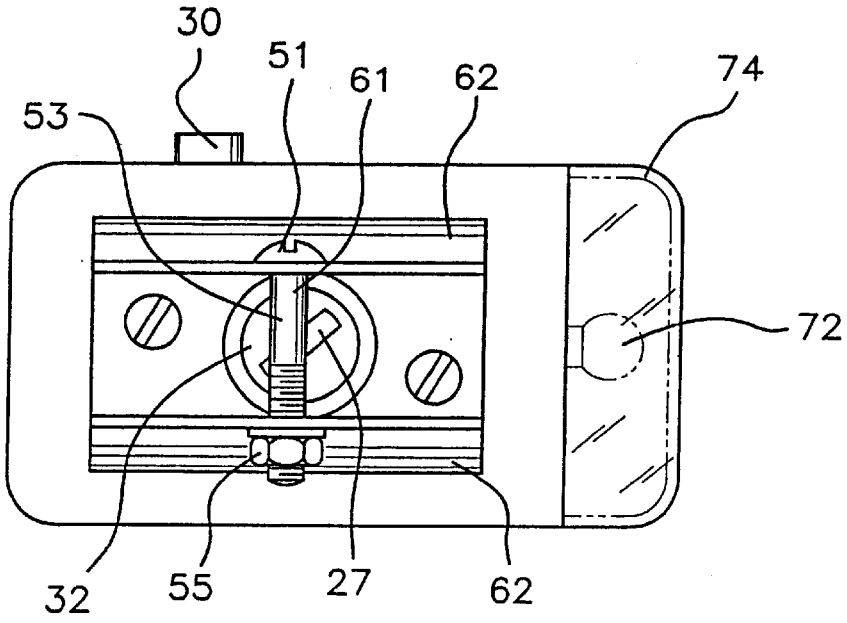
FIG. 2 is a bottom view of the present invention.
Figure 3:
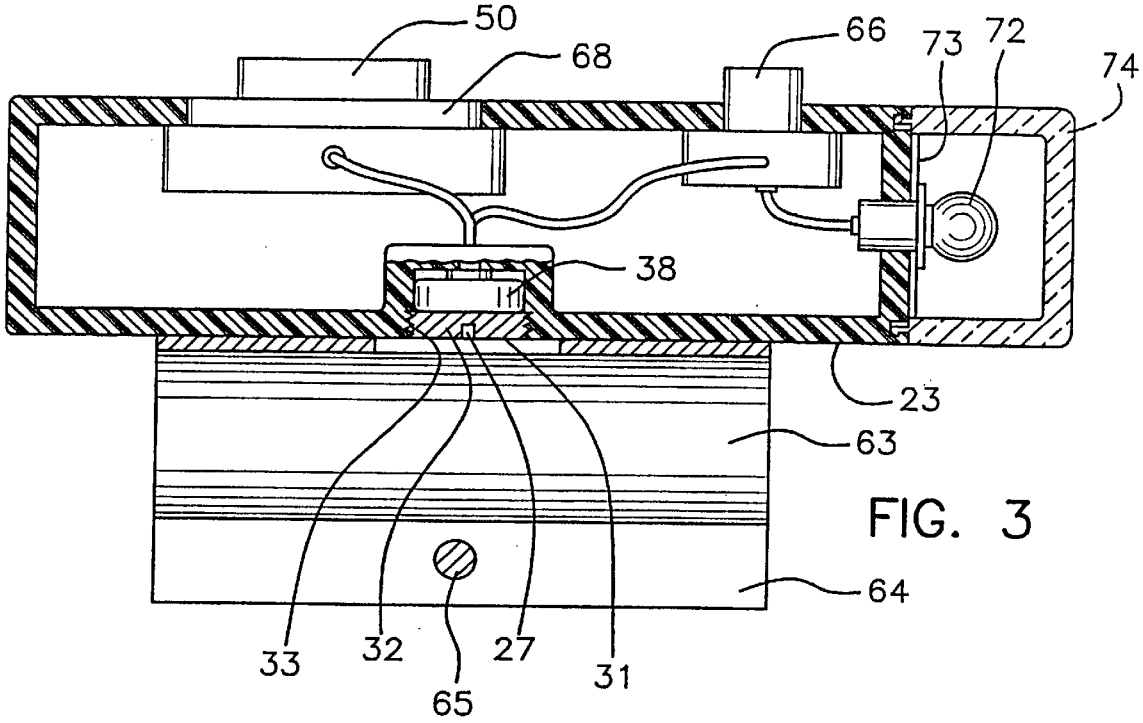
FIG. 3 is a cross-sectional view of the present invention taken along line 3—3 of FIG. 1.
Figure 4:
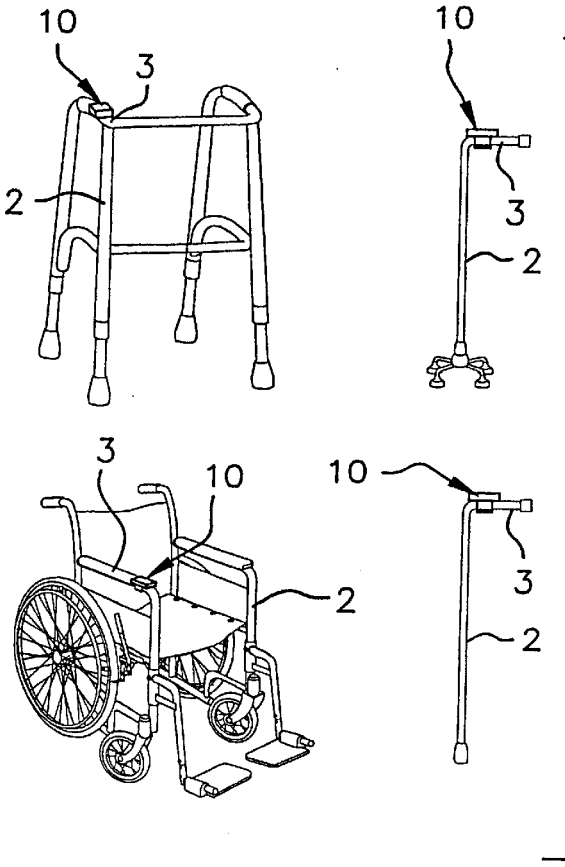
FIG. 4 is an in-use view of the present invention.
Figure 5:
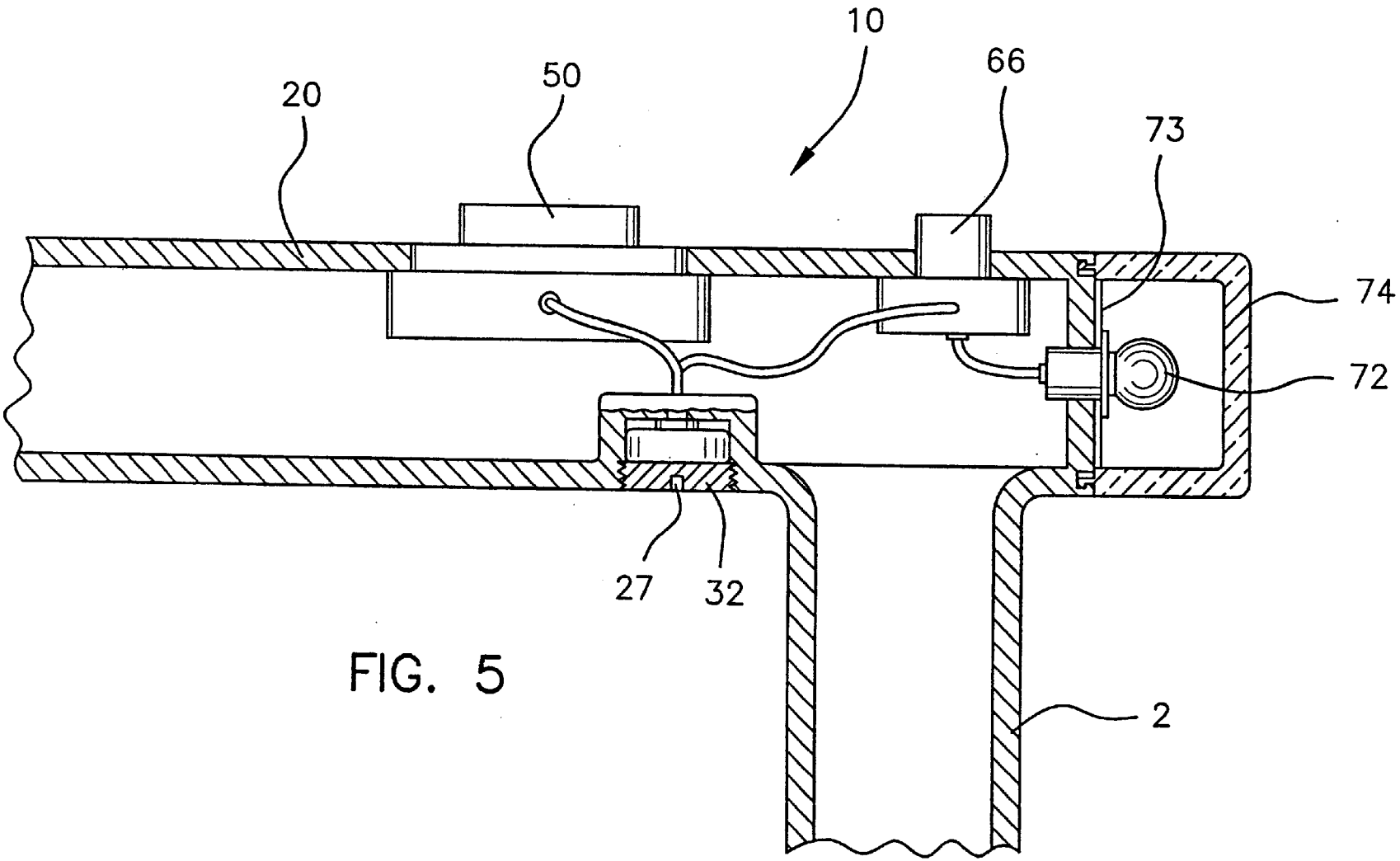
FIG. 5 is a cross-sectional view of the integrally attached embodiment of the present invention.

With reference now to the drawings, and in particular to FIGS. 1 through 5 thereof, a new personal security assembly embodying the principles and concepts of the present invention and generally designated by the reference numeral 10 will be described.

As best illustrated in FIGS. 1 through 5, the personal security assembly 10 generally comprises a housing 20, an alert light 30, an audio transmitter 40 and an activation button 50. In alternate embodiments described in more detail below, the housing 20 may be designed for coupling to a mobility aide 2, such as a wheelchair, walker or cane, or may be an integral part of the structure of the mobility aide.

The alert light 30 is coupled to the housing 20 for emitting a visual signal that a user is in distress upon activation of the alert light 30. Typically, the alert light is provided to emit a red flashing light.

The audio transmitter 40 is coupled to the housing 20 for emitting an audible sound upon activation of the audio transmitter 40 to draw attention in the direction of the mobility aide.

The activation button 50 is operationally coupled to the alert light 30 and the audio transmitter 40 for activating the alert light 30 and the audio transmitter 40 upon depression of the activation button 50.

An illuminatable ring 68 is coupled to the housing 20 and positioned to surround the activation button 50 to assist in locating the activation button 50 during low light conditions.

For providing removable coupling of the housing 20 to the mobility aide 2, a clamp assembly 60 is coupled to the housing 20. The clamp assembly 60 is designed for engaging an elongated member 3 of the mobility aide 2. Thus, the housing 20 is coupled to the mobility aide 2.

A battery 38 is electrically couplable to the audio transmitter 40 and the alert light 30. The housing 20 includes a generally cylindrical battery chamber 24. An outer portion 25 of a wall 26 of the battery chamber 24 is threaded. The battery 38 is positioned in the battery chamber 24.

A generally disk-shaped battery cover 32 has a threaded outer perimeter 33 for engaging the threaded outer portion 25 of the wall 26 of the battery chamber 24. The battery cover 32 is couplable to the housing 20 such that an outer surface 31 of the battery cover 32 is positioned flush with a lower surface 23 of the housing when the battery cover 32 is coupled to the housing 20. The battery cover 32 further includes a slot 27 for facilitating rotation of the battery cover 32 for uncoupling the battery cover 32 from the housing 20. The battery cover 32 is designed for covering the battery chamber 24 such that the battery 38 is held within the battery chamber 24 when the cover 36 is coupled to the housing 20.

In the removable version, the clamp assembly 60 is positioned such that opposite arm portions 62 of the clamp assembly 60 are positioned on opposite sides of the battery cover 32. Thus, the elongated member 3 of the mobility aide 2 is positioned adjacent to the battery cover 32 when the clamp assembly 60 is engaged to the elongated member 3 of the mobility aide 2 for inhibiting access to the battery chamber 24 while the clamping assembly 60 is engaged to the elongated member 3 of the mobility aide 2.

Each of the arm portions 62 includes an arcuate portion 63 and a planar portion 64. The arcuate portions 64 are positioned for receiving the elongated member 3 of the mobility aide 2 therebetween. A pair of clamp apertures 65 are each positioned in an associated one of the planar portions 64. The clamp apertures 65 are substantially aligned with each other. A bolt member 61 is provided having a head portion 51 and a rod portion 53. The rod portion 53 is insertable through the aligned clamp apertures 65. A nut member 55 is selectively engageable to the rod portion 53 of the bolt member 61 for urging the opposing arm portions 62 towards each other for clamping the elongated member 3 between the arm portions 62.

In an embodiment, a secondary light assembly 70 is coupled to the housing 20. The secondary light assembly 70 is designed for selectively illuminating an area adjacent to the mobility aide 2 when the housing 20 is coupled to the mobility aide 2. The secondary light assembly 70 includes a light bulb 72 that extends from a forwardly facing end 29 of the housing 20.

The secondary light assembly 70 also includes a reflector 73 positioned adjacent to the light bulb 72 for directing light from the light bulb 72 in a beam outwardly from the end of the housing 20.

The secondary light assembly 72 also includes a transparent cover member 74 couplable to the housing 20 for covering the light bulb 72.

A light activation button 66 is coupled to the housing 20. The light activation button 66 is operationally coupled to the light bulb 72 such that the light bulb 72 is illuminatable by pressing the light activation button 66.

When integrally incorporated into the mobility aide 2, the mobility aide 2 has a generally horizontal portion when the mobility aide 2 is in an upright position.

A forwardly positioned portion of the horizontal portion forms the housing 20. The alert light 30 is coupled to a longitudinal side of the housing 20 for emitting a visual signal that a user is in distress upon activation of the alert light 30.

The housing 20 includes an audio aperture 12 positioned adjacent to the audio transmitter 40. The activation button is coupled to an upper surface 14 of the housing 20.

In use, the device is integrally incorporated into a mobility aide or is clamped to an existing mobility aide. When needing help, a user pushes the activation button for activating the alert light and audio transmitter to alert surrounding persons that the user is in a state of distress and requires assistance. Upon pressing the light activation button, the secondary light assembly is activated to illuminate an area adjacent to the mobility aide. Preferably, the secondary light assembly is oriented to direct light in a forward direction during use of the mobility aide.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A personal security device comprising:

a housing, said housing being adapted for coupling to a mobility aide;

an alert light coupled to said housing for emitting a visual signal that a user is in distress upon activation of said alert light;

an audio transmitter coupled to said housing for emitting an audible sound upon activation of said audio transmitter;

an activation button operationally coupled to said alert light and said audio transmitter for activating said alert light and said audio transmitter upon depression of said activation button;

a battery electrically couplable to said audio transmitter and said alert light;

said housing including a battery chamber, said battery being positioned in said battery chamber;

a battery cover couplable to said housing for covering said battery chamber such that said battery is held within said battery chamber when said cover is coupled to said housing;

a clamp assembly coupled to said housing, said clamp assembly being adapted for engaging an elongated member of the mobility aide whereby said housing is coupled to the mobility aide; and said clamp assembly being positioned such that opposite arm portions of said clamp assembly are positioned on opposite sides of said battery cover whereby the elongated member of the mobility aide is positioned adjacent to said battery cover when said clamp assembly is engaged to the elongated member of the mobility aide for preventing access to said battery chamber while said clamping assembly is engaged to the elongated member of the mobility aide.

2. The personal security device of claim 1, further comprising:

a clamp assembly coupled to said housing, said clamp assembly being adapted for engaging an elongated member of the mobility aide whereby said housing is coupled to the mobility aide.

3. The personal security device of claim 1, further comprising:

a secondary light assembly coupled to said housing, said secondary light assembly being for selectively illuminating an area adjacent to the mobility aide when the housing is coupled to the mobility aide.

4. The personal security device of claim 3, further comprising:

said secondary light assembly including a light bulb, said light bulb extending from an end of said housing;

said secondary light assembly including a reflector positioned adjacent to said light bulb for directing light from said light bulb in a beam outwardly from said end of said housing.

5. The personal security device of claim 4, further comprising:

said secondary light assembly including a transparent cover member couplable to said housing for covering said light bulb.

6. The personal security device of claim 4, further comprising:

a light activation button coupled to said housing, said light activation button being operationally coupled to said light bulb such that said light bulb is illuminatable by pressing said light activation button.

7. The personal security device of claim 2, further comprising:

said clamping assembly including a pair of opposing arm portions, each of said arm portions including an arcuate portion and a planar portion, said arcuate portions being positioned for receiving the elongated member of the mobility aide therebetween;

a pair of clamp apertures, each of said clamp apertures being positioned in an associated one of said planar portions, said clamp apertures being substantially aligned with each other;

a bolt having a head portion and a rod portion, said rod portion being insertable through said aligned clamp apertures;

a nut member, said nut member being selectively engageable to said rod portion of said bolt member for urging said opposing arm portions towards each other.

8. The personal security device of claim 1, further comprising:

an illuminatable ring positioned around said activation button for facilitating locating of said activation button during low light conditions.

9. A personal security device comprising:

a mobility aide having a generally horizontal portion when said mobility aide is in an upright position;

a forwardly positioned portion of said horizontal portion forming a housing integral to said mobility aide;

an alert light coupled to a longitudinal side of said housing for emitting a visual signal that a user is in distress upon activation of said alert light;

an audio transmitter positioned in said housing, said housing including an audio aperture positioned adjacent to said audio transmitter, said audio transmitter being for emitting an audible sound upon activation of said audio transmitter;

an activation button operationally coupled to said alert light and said audio transmitter for activating said alert light and said audio transmitter upon depression of said activation button, said activation button being coupled to an upper surface of said housing;

an illuminatable ring coupled to said housing, said ring being positioned around said activation button for facilitating locating of said activation button during low light conditions;

a battery electrically couplable to said audio transmitter, said illuminatable ring and said alert light;

said housing including a generally cylindrical battery chamber, an outer portion of a wall of said battery chamber being threaded, said battery being positioned in said battery chamber;

a generally disk-shaped battery cover having a threaded outer perimeter for engaging said threaded outer portion of said wall of said battery chamber, said battery cover being couplable to said housing such that an outer surface of said battery cover is positioned flush with a lower surface of said housing when said battery cover is coupled to said housing, said battery cover including a slot for facilitating rotation of said battery cover for uncoupling said battery cover from said housing, said battery cover being for covering said battery chamber such that said battery is held within said battery chamber when said cover is coupled to said housing;

a secondary light assembly coupled to said housing, said secondary light assembly being for selectively illuminating an area adjacent to the mobility aide when the housing is coupled to the mobility aide;

said secondary light assembly including a light bulb, said light bulb extending from a forwardly facing end of said housing;

said secondary light assembly including a reflector positioned adjacent to said light bulb for directing light from said light bulb in a forward direction;

said secondary light assembly including a transparent cover member having a connection portion couplable to a slotted groove in said housing such that said transparent cover covers said light bulb; and a light activation button coupled to said upper surface of said housing, said light activation button being operationally coupled to said light bulb such that said light bulb is illuminatable by pressing said light activation button.

* * * * *